US007410062B2

(12) United States Patent
Monk

(10) Patent No.: US 7,410,062 B2
(45) Date of Patent: Aug. 12, 2008

(54) BOX

(75) Inventor: Robert William Monk, Dartford (GB)

(73) Assignee: Jacob White (Packaging) Ltd (GB)

( * ) Notice: Subject to any disclaimer, the term of this patent is extended or adjusted under 35 U.S.C. 154(b) by 461 days.

(21) Appl. No.: 11/035,045

(22) Filed: Jan. 14, 2005

(65) Prior Publication Data

US 2005/0155905 A1 Jul. 21, 2005

(30) Foreign Application Priority Data

Jan. 16, 2004 (GB) ..... 0400969.2

(51) Int. Cl.
*B65D 79/00* (2006.01)

(52) U.S. Cl. ..... 206/774; 206/736; 206/731; 53/467

(58) Field of Classification Search ..... 206/738, 206/746, 774, 526, 751, 736; 229/200, 235, 229/240, 243, 244; 53/428, 467
See application file for complete search history.

(56) References Cited

U.S. PATENT DOCUMENTS

| | | | | |
|---|---|---|---|---|
| 2,577,765 | A * | 12/1951 | Irmscher | 426/77 |
| 3,917,158 | A * | 11/1975 | Dorofachuk et al. | 229/241 |
| 4,058,206 | A * | 11/1977 | Morse et al. | 229/241 |
| 4,458,468 | A * | 7/1984 | Sivilich | 53/428 |
| 4,488,675 | A | 12/1984 | von Gnechten et al. | |
| 6,755,306 | B2 * | 6/2004 | Maus | 206/774 |
| 2002/0175095 | A1 * | 11/2002 | Boriani et al. | 206/273 |
| 2002/0175106 | A1 * | 11/2002 | Nemoto | 206/526 |
| 2004/0163994 | A1 * | 8/2004 | Gardner et al. | 206/736 |

FOREIGN PATENT DOCUMENTS

| | | |
|---|---|---|
| EP | 1 008 533 | 6/2000 |
| FR | 2 794 681 | 12/2000 |
| GB | 2 176 172 | 12/1986 |
| WO | WO-02/22450 | 3/2002 |

OTHER PUBLICATIONS

Patent Abstracts of Japan, vol. 1996, No. 06, Jun. 28, 1996—& JP 08 048324 A (Kao Corp), Feb. 20, 1996 *abstract*.

* cited by examiner

*Primary Examiner*—David T Fidei
(74) *Attorney, Agent, or Firm*—Stites & Harbison PLLC; Marvin Petry

(57) ABSTRACT

A box suitable for packaging a product during transportation comprises a closed structure formed from a folded blank which is separable into a tray part and a lid part along breakable lines of weakness. The tray part is suitable for displaying the product e.g. for retail. The box is strengthened by top side flaps whose bottom edges abut the base of the box and the top edge of the bottom side flaps.

12 Claims, 5 Drawing Sheets

BOX

FIELD OF THE INVENTION

The present invention relates to packaging. In particular, it relates to boxes for transporting, displaying and/or dispensing a product or products, particularly a plurality of loose items. The products may be perishable or non-perishable. If they are perishable, then they are usually sealed in individual wrapping before being packaged in the box. An example is a box for dispensing sachets of liquid e.g. cooking sauce.

BACKGROUND

A known type of display/dispenser box used to store products during transportation is formed in two parts. A dispensing part, or tray, holds a product (e.g. sachets) to be dispensed. The tray has a rectangular base with a wall upstanding around its edge. The wall includes a tall back face for supporting the product and a short front face which allows the product to be seen; the front and back faces are joined by side walls which confine the product in the tray. The side walls may have inward flanges with undulating edges extending into the tray from their top edges to hold the product upright. The tray is assembled by hand from a blank. To increase the speed of this process, the base of the tray has a crash lock base. This is relatively costly to manufacture.

After the tray is erected, a corrugated cover is inserted into the tray and it is loaded with a product. This is also done by hand. The corrugated cover is usually a stiff piece of board having a top surface lying over the product and two opposing side walls depending from two edges of the top surface which fit in between the product and the side walls of the tray to abut the base of the tray.

The product is also inserted by hand in small amounts; this can be difficult, especially if the product is quite dense and there is little room between it and the side walls of the tray.

After loading the product, the whole package is shrink-wrapped in plastics sheeting to keep the cover together with the tray and to prevent contamination or spillage of the product. The cover is inserted into the tray to give the structure additional strength. This allows many such structures to be stacked on top of one another without the use of an outer case. This arrangement is convenient for transportation.

However, the known box described above has a number of disadvantages.

Firstly, the assembly and loading of the box prior to shrink-wrapping is all done by hand. This is labour-intensive and slow.

Secondly, the assembled box needs to be shrink-wrapped to be of use. Shrink-wrapping adds another layer of material to the product, which incurs further expense. Moreover, shrink-wrap is not an environmentally friendly material and requires a sharp instrument to remove it.

SUMMARY OF THE INVENTION

The present invention aims to ameliorate the problems associated with prior art packaging.

The present invention proposes a box for packaging an product, wherein the configuration of the box possesses intrinsic strength without the need for shrink-wrapping; preferably this box is formed from a one-piece blank.

The box may be constructed using an entirely automated process, thereby saving labour costs.

According to a first aspect of the present invention, there is provided a box formed of a folded blank and having a closed structure having top, base and front and rear end faces and respective pairs of side flaps connected by fold lines respectively to said top and said base, all provided by said blank, and having breakable weakness lines allowing when broken complete separation of a top portion including at least part of said top from the remainder of the box, the remainder constituting a tray structure, wherein said side flaps provide vertical support of said top portion on said tray structure.

Preferably said vertical support of said top portion on said tray structure is provided by at least one of (a) contact of a said side flap attached to said top with said base, (b) contact of a said side flap attached to said base with said top, and (c) edge-to-edge contact of said side flap attached to said top with another said side flap attached to said base. Suitably said contacts (a) and (c) are both provided by respective portions of said side flap attached to said top. Preferably said side flap attached to said top has longer and shorter portion, e.g. has a generally T-shaped configuration, with the longer portion providing said contact (a) and the shorter portion providing said contact (c).

The box has intrinsic strength because of the vertical support provided by the side flaps. Preferably side flaps of the lid abut both the base of the tray and the rim of the tray when the top surface of the lid is pressed down. Thus, the box of the present invention can easily support other such boxes stacked on it without the need for extra reinforcing parts.

The removable top portion or lid is releasably attached to the tray to facilitate easy removal when it is decided to display and/or dispense a product stored in the box. Even after the lid has been detached from the tray, the box retains strength.

Preferably, the blank from which the box is formed is made in a single piece. This allows for easy manufacture.

Preferably, the base of the tray has a rectangular shape and a side wall of the tray comprises two opposed side faces connected by a front face and a back face. The side wall thus defines a recess in which the product may be stored and/or displayed. The back face may be substantially all of the back side of the box. This helps to support the product stored in the tray. Products stacked in the recess of the tray may have a tendency to topple backwards; a taller back face prevents this from happening.

The side faces of the tray may have a variable height. They may be mirror images of each other. They may increase in height towards the back side of the box. More preferably, the side faces have a top edge which is substantially horizontal, i.e. substantially parallel to the plane of the base of the tray; this configuration maximises the rate at which a machine produces blanks.

Preferably, the lid is only attached (by the weakness lines) to the front and back faces of the tray. This means the rim of the tray along its side faces (i.e. the top edge of the side faces) may be free from jagged edges, which improves the overall appearance of the tray when displaying the product.

The or each side flap of the top portion may have a T-shaped configuration whereby the underside of the crossbar of the T abuts the upper edge of the corresponding side face of the tray and the stem of the T includes an overlap portion. In this case, both the vertical support types (a) and (c) mentioned above are on the opposed side flaps of the lid. There are thus two points of abuttal and therefore support. The first is the edge of the overlap portion abutting the base of the tray as explained above. The second is the edges of the underside of the crossbar of the T abutting the top of the side face. The underside may be shaped to match the shape of the side faces so the whole underside of the crossbar abuts the top edge of the side face. The strength of the structure comes from two substantially coplanar sheets abutting each other along a common edge. Such a connection has good compressive strength.

Preferably, the front face of the tray is attached to the side face of the tray adjacent to it by an overlapping first tab. This connection strengthens the front corners of the tray.

Preferably, the front surface of the box is attached to the side flap of the lid adjacent to it by an overlapping second tab. This connection strengthens the front corners of the lid.

Preferably, the first tab overlaps with the side face of the tray; it may thus be provided on the corresponding side edge of the front face of the tray.

Preferably, the second tab overlaps with the side face of the lid; it may thus be provided on the corresponding side edge of the front face of the lid.

The first and second tabs may be provided on a single tab, in which case the line of weakness between the tray and the lid extends across that single tab to allow detachment of the lid from the tray. When the corners of the tray and the lid are supported by tabs, the intrinsic strength of the box is increased because the upstanding edges at the front of the box are reinforced by the tabs.

Preferably, the back face of the tray is attached to the side face of the tray adjacent to it by an overlapping third tab. To allow for easy removal of the lid from the tray, the back surface of the box may not be attached to the side flaps of the lid. The side flaps may be held in place by the overlap portion extending inside the side faces of the tray.

Preferably, the line of weakness comprises cuts and/or perforations. Preferably the amount of perforations is minimised to give the box a good appearance when used to display products.

According to a second aspect of the present invention, there is provided a method of forming and loading a box according to the invention, the method including the steps of:

erecting the blank into a configuration where the top, base and front and rear faces are positioned to form the box and one of the sides of the box is closed while the other side is open;

loading a product through the open side; and thereafter closing the open side.

Preferably, the method may be carried out by a machine; the automated process of assembling and loading a box is much quicker than the hand-assembly method of the prior art.

In another aspect the invention provides a blank for forming a box having, in one piece, at least the following portions:— rectangular top, base and front and rear end faces of the box, connected by three parallel transverse fold lines;

a pair of first side flaps connected by longitudinal fold lines to said base and having a height less than said height of said end faces;

a pair of second side flaps connected by longitudinal fold lines to said top and each having at least one of (a) a portion of a height substantially equal to the height of said end faces and (b) a portion having a height such that in the erected box it makes edge-to-edge contact with an upper edge of the corresponding said first side flap;

two breakable weakness lines which, when broken, separate at least part of said top completely from said base.

BRIEF DESCRIPTION OF THE DRAWINGS

Preferred embodiments of the invention will now be described by way of example with reference to the accompanying drawings, in which.

DESCRIPTION OF EMBODIMENTS

Figure 1:
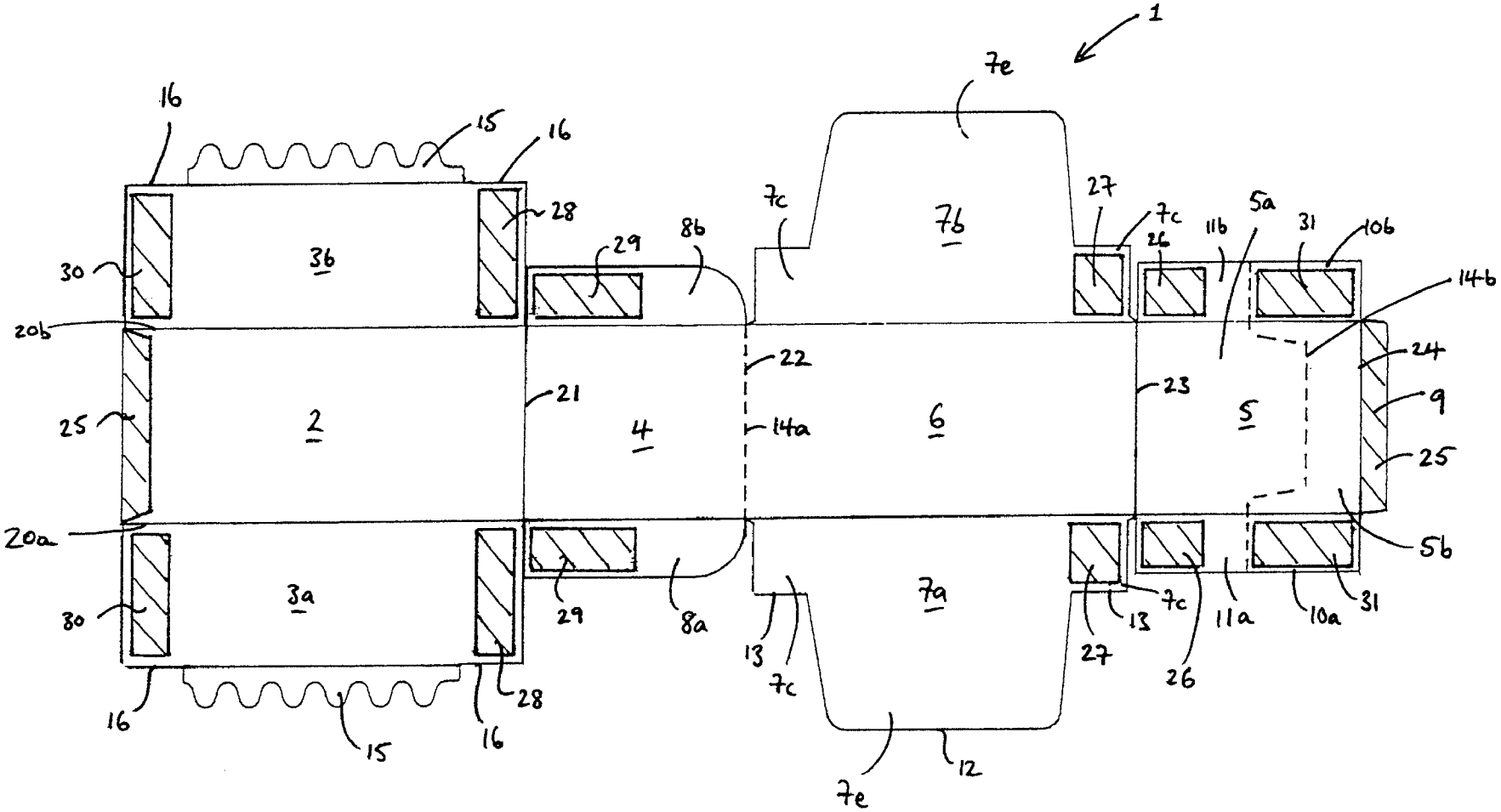
FIG. 1 shows a blank for forming a box which is an embodiment of the present invention.

FIG. 1 shows a blank 1 cut from a larger piece of suitable material. The blank has fold lines and faces attached at various places as described below to form a box embodying the present invention. The material from which the blank 1 is formed may be solid board or craft board. The tougher cardboard that is used in known packaging does not have to be used in the present application because of the intrinsic strength of the box design. The folds lines may be creases or scores. These folds define the relevant surfaces of the box. The fold lines consist of two parallel longitudinal fold lines 20*a*, 20*b* and four parallel transverse fold lines 21,22,23,24 (fold line 22 coincides with a breakable line 14*a* of weakness described below).

The assembled box has a rectangular base 2 joined at the fold lines 20*a*, 20*b*, to side faces 3*a*, 3*b* forming flanges along its opposed longer edges. A back face 4 is attached to one of the shorter edges of base 2 at the fold line 21; the other shorter edge is free in the blank as cut. A front face 5 is attached to the free edge of the base 2 using an attachment flap 9 joined to the front face 5 at the fold line 24. The front face 5 and the back face 4 are connected by a rectangular top 6, which is the same shape as and overlies the base 2 in the assembled box. The top 6 has side flaps 7*a*, 7*b* joined along its opposed long edges at the fold lines 20*a*, 20*b*. The back face 4 has back tabs 8*a*, 8*b* joined along its side edges at the fold lines 20*a*, 20*b*. the front face 5 has front tabs 10*a* and 11*a*, 10*b* and 11*b*, joined along its side edges at the fold lines 20*a*, 20*b* (each front tab is in two portions 10*a* and 11*a*, 10*b* and 11*b* joined at a line 14*b* of weakness described below).

To form the box, the blank is folded so that top 6 overlies base 2 with front and back faces 4, 5 extending vertically between them. This loop structure is fixed when attachment flap 9 is secured (e.g. by adhesive) to base 2 along its free edge at an adhesion region 25 seen in FIG. 1. In this state the blank can lie flat, for compact and easy transport. When it is to be filled, it is erected and adhesive is applied where required to secure it in its assembled state, as follows. To form the side walls, back tabs 8*a*, 8*b* and front tabs 10*a*, 10*b*, 11*a*, 11*b* are folded inwards. Side flaps 7*a*, 7*b* are folded down and attached by adhesive to front tabs 11*a*, 11*b* respectively at adhesion regions 26, 27. Side faces 3*a*, 3*b* are folded upwards and affixed by adhesive to back tabs 8*a*, 8*b* at adhesion regions 28, 29 and front tabs 10*a*, 10*b* at adhesion regions 30, 31. Thus, side faces 3*a*, 3*b* overlap with a portion of side flaps 7*a*, 7*b* and lie outside the side flaps 7*a*, 7*b*.

Lines 14*a*, 14*b* of weakness allowing easy breakage by the user are provided in two places on the box. Firstly, the fold line between the top 6 and the back face 4 is a line of weakness 14*a*. Thus, the top 6 can be detached from the back face 4. Secondly, a line 14*b* of weakness is provided across the front face 5 and front tabs 10*a*, 10*b*, 11*a*, 11*b*. This line 14*b* of weakness divides front face 5 into an upper portion 5*a* and a lower portion 5*b*. The upper portion 5*a* has front tabs 11*a*, 11*b* associated with it; the lower portion 5*b* has front tabs 10*a*, 10*b* associated with it. The upper portion 5*a* is attached to the side flaps 7*a*, 7*b* by front tabs 11*a*, 11*b* respectively. The lower portion 5*b* is attached to the side faces 3*a*, 3*b* by front tabs 10*a*, 10*b* respectively. In the blank shown in FIG. 1 and in the assembled box, the side flaps 7*a*, 7*b* are not attached to back tabs 8*a*, 8*b*. The side faces 3*a*, 3*b* and the side flaps 7*a*, 7*b* thus overlap to form the sides of the closed box but are not attached directly to each other by adhesive. The side flaps 7*a*, 7*b* extend the full height of the box, the side faces 3*a*, 3*b* less than the full height. A top lid-like portion of the box comprising top 6, upper portion 5*a*, side flaps 7*a*, 7*b* and front tabs 11*a*, 11*b* can therefore be detached to leave a bottom tray-like part, which comprises the remaining parts of the blank.

The lines 14*a*, 14*b* of weakness on which the lid-like part can be detached from the tray-like part may be formed in any manner known in the art, but preferably are a combination of cuts through the material and perforation lines along the parts which join the material together. The perforations are kept to a minimum to give the detached product a better appearance. When objects are separated along perforated lines, the remains of the perforations can be jagged and unsightly. The box minimises the amount of residue of perforation lines, which may remain visible.

The side flaps 7*a*, 7*b* of the box are given a T-shaped configuration which provides two features that increase the intrinsic strength of the box in its assembled state.

Firstly, the stem 7*e* of each T-shaped flap 7*a*, 7*b* has a bottom edge 12 which abuts the base 2 when the top 6 is pressed downwards. It is preferable that the edges 12 are always in contact with the base 2 when the box is initially constructed, but the same effect can be achieved if a small gap is present; in this case, when the top 6 is pressed downwards, the side flaps 7*a*, 7*b* will move downward until the edges 12 abut the base 2. At the point of abuttal, the top 6 is strongly supported on the base 2 by the stem of the T, which acts as a column structure. In this configuration, the compressive strength of the box in the downward direction is high, thereby enabling stacking of e.g. other boxes on top of the assembled box without collapsing.

Figure 6:
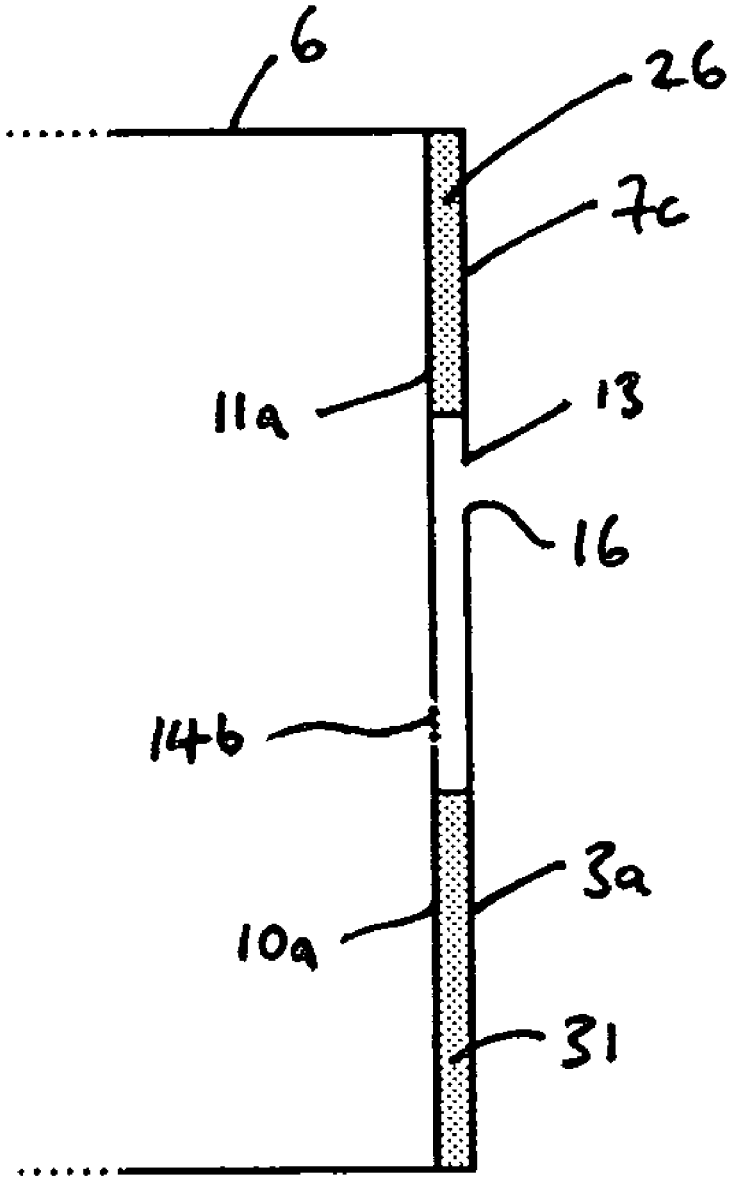
FIG. 6 is a partial cross-section of the box, transversely at a region near the front face.

Secondly, the end portions 7*c* of the crossbar of each T-shaped flap 7*a*, 7*b* have underside edges 13, which abut the corresponding end parts of the top edge 16 of the side faces 3*a*, 3*b* at least when the top 6 of the assembled box is pushed downwards. Again, it is preferably that the edges 13 are always in contact with the top edges 16 when the box is assembled, but the same effect is achievable when there is a small gap. This abutment of the respective edges 13, 16 is edge-to-edge contact but is achieved because the stem 7*e* extends inside the side face 3*a* or 3*b*. The stiffness in the flap 7*a* or 7*b* thus locates the edge 13 on the edge 16. This contact of these edges has a load-bearing capability. The arrangement at this region of the box side is shown in section in FIG. 6.

The assembled box is useful for both transporting and displaying individually packaged products (e.g. sachets). The products are packaged in the complete assembled box for transporting. The whole box is formed from a one-piece blank, without the need for shrink-wrapping or other additional packaging or parts. Thus, the manufacture and the loading process is improved. Moreover, the assembled box has a good intrinsic strength to allow extensive stacking, which is useful in transportation.

When the box reaches a destination where the product contained in it is to be e.g. sold, the box may be opened by detaching the top lid-like portion (by breaking along the lines 14*a*, 14*b* of weakness); the bottom part of the box then serves as a display tray.

As can be seen, in the front face 5, the line 14*b* of weakness is not straight, but has a lower central portion, to allow easier removal of the product from the box. Any suitable shape may be used for this line 14*b*.

The display tray has a base 2 with a side wall upstanding all around its edge to form a recess for holding the product. The side wall includes two opposed side faces 3*a*, 3*b* attached to a back face 4 by back flaps 8*a*, 8*b* respectively and a front face 5*b* by front tabs 10*a*, 10*b* respectively. The back face 4 may, as shown, extend higher than the side faces 3*a*, 3*b* e.g. to display advertising or other information relating to the displayed product. The side faces 3*a*, 3*b* may have, as shown, inwardly folded separator flaps 15 with undulating edges provided along their top edge. When the box is opened by detaching the top part from the bottom part along the lines 14*a*, 14*b* of weakness, the separator flaps may be folded inwards to support the product (e.g. sachets), e.g. by preventing them from toppling backwards or forwards.

Figure 2:
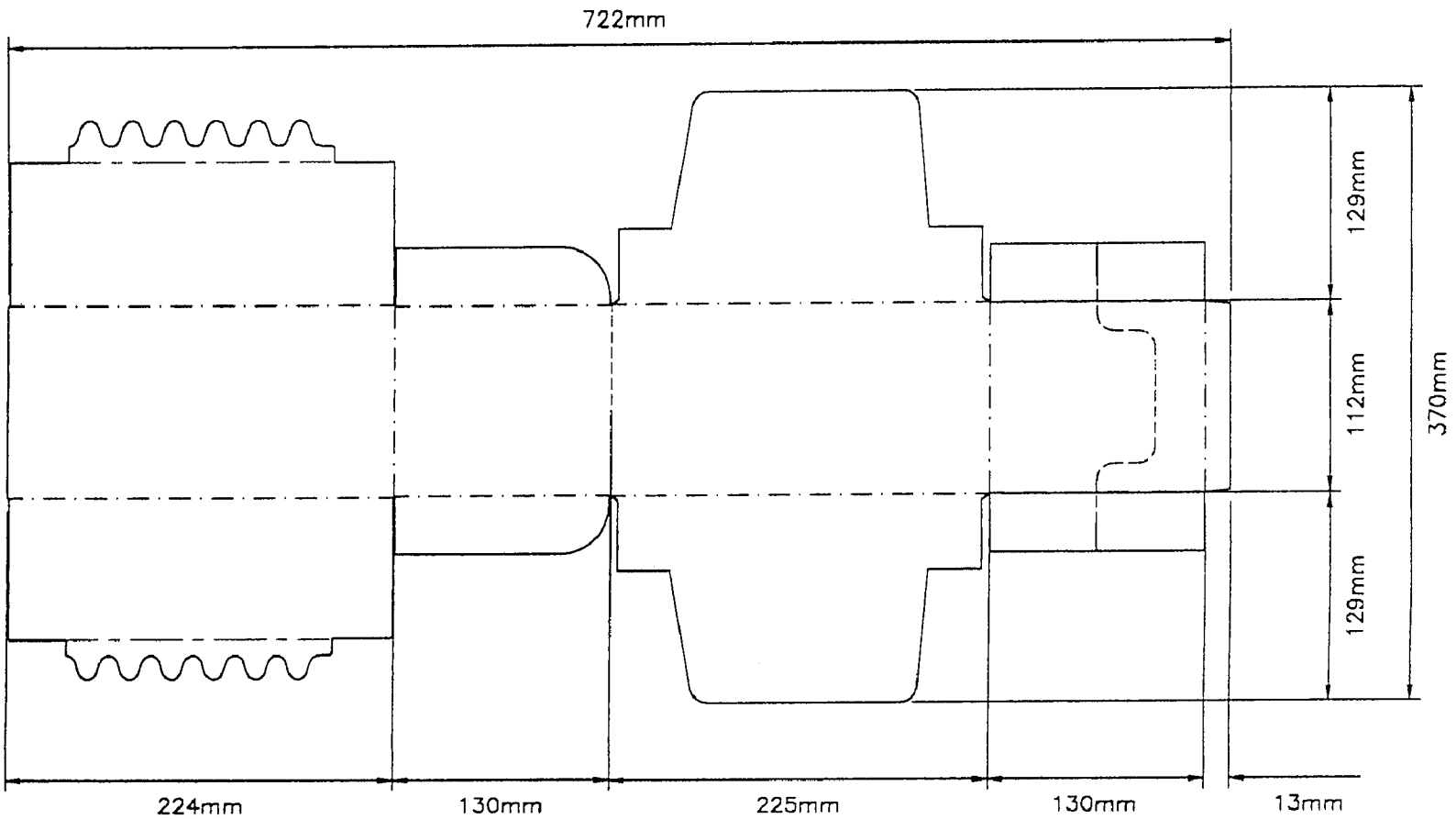
FIG. 2 shows the blank of FIG. 1 with exemplary dimensions indicated.

FIG. 2 shows the same blank 1 as depicted in FIG. 1, and includes various dimensions for different parts of the blank. Of course, the dimensions of the box may be chosen to correspond to the product to be displayed.

Typically, however, the length of the box will be less than 750 mm, preferably less than 500 mm, more preferably less than 300 mm. Its length is usually greater than 100 mm.

The width of the box may be about half the length, i.e. less than 400 mm, preferably less than 250 mm, more preferably less than 150 mm. Its width may be greater than 80 mm.

The height of the box will typically be about half the length, i.e. less than 300 mm, preferably less than 250 mm, more preferably less than 125 mm. Its height is usually greater than 25 mm.

Figure 3:
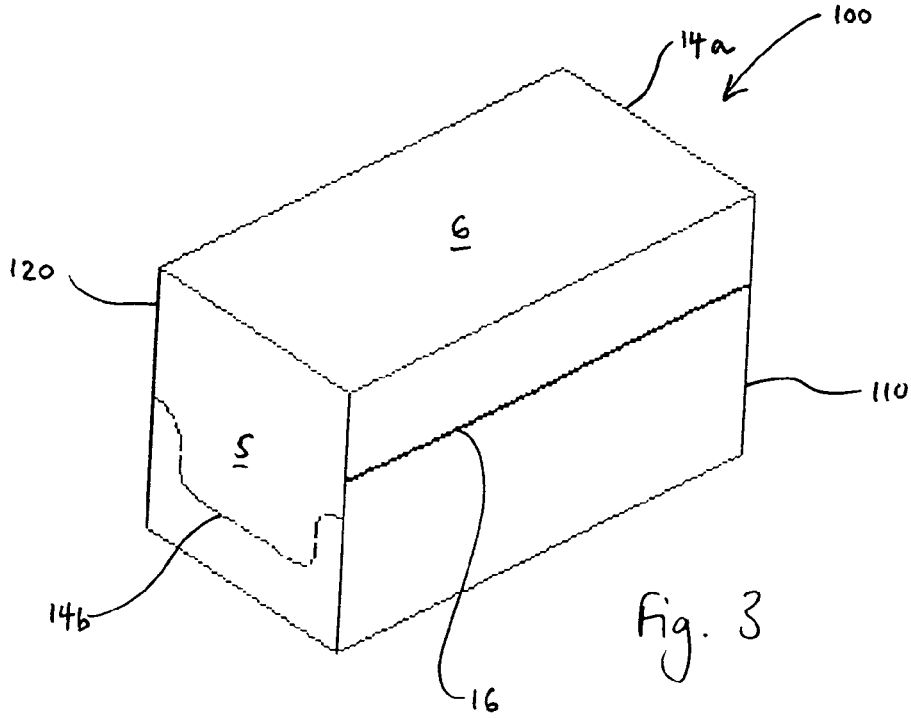
FIG. 3 is a perspective view of a box formed from the blank of FIG. 1.

FIG. 3 shows the assembled box 100. Here, the tray 110 and lid 120 are clearly visible. They are separated by the lines 14*a*, 14*b* of weakness and top edge 16 of the side faces 3*a*, 3*b*.

Figure 4:
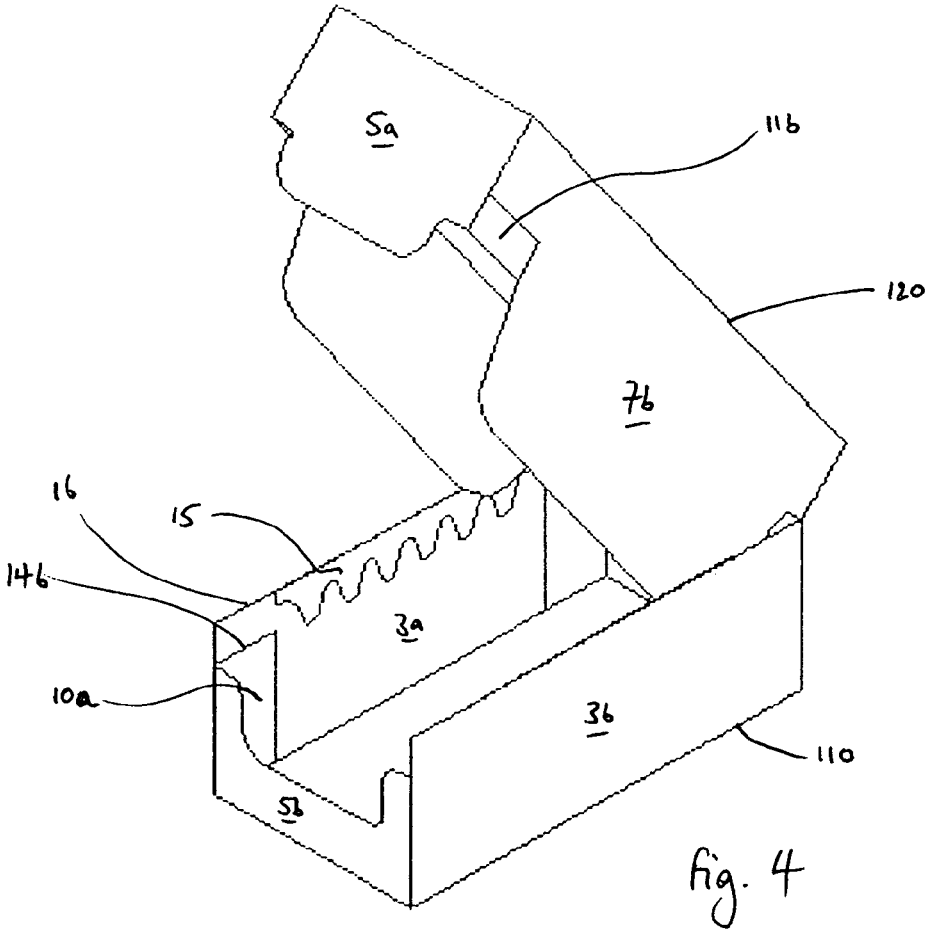
FIG. 4 is a perspective view of the box of FIG. 3 in a partly opened state.

FIG. 4 shows the box of FIG. 3 in a partly open state. The lid 120 has been detached from the tray 110 along the lines 14*a*, 14*b* of weakness. The lid 120 is shown lifted away from the tray 110 to enable us to view the inside of the tray. At the front of the tray 110, we see one front tab 10*a* folded around and attached to side face 3*a*. Front tab 10*a* does not extend up the full height of side face 3*a* in this drawing, i.e. the line 14*b* of weakness is located some way below the top edge 16 of that side face 3*a*. Thus a portion of the front tab 11*a* which was connected to the front tab 10*a* along the line 14*b* of weakness overlapped with the side face 3*a*. However, in order to permit removal of the lid 120 from the tray 110, the front tab 11*a* is only fixed to the side flap 7*a* of the lid 120. Therefore, the portion of front tab 11*a* which overlapped with side face 3*a* will not have any adhesive on it. The same is true of the other side of the box. The exposed part of front tab 11*b* is visible in FIG. 4; although this part overlaps with side face 3*b* in the closed box, it is not attached to it.

A similar arrangement is present at the back face 4 of the box 100. Portions of back tabs 8*a*, 8*b* overlap with parts of side flaps 7*a*, 7*b*, respectively, but are not attached thereto, thereby permitting removal of the lid 120 from the tray 110.

As visible from FIGS. 1 and 2, the stems of the T-shaped flaps 7*a*, 7*b* are tapered to facilitate removal of the lid 120 from the tray 110. The tapering nature of the stem prevents it from abutting the front tabs 10*a*, 10*b*, when the lid 120 is removed from the tray 110.

Figure 5:
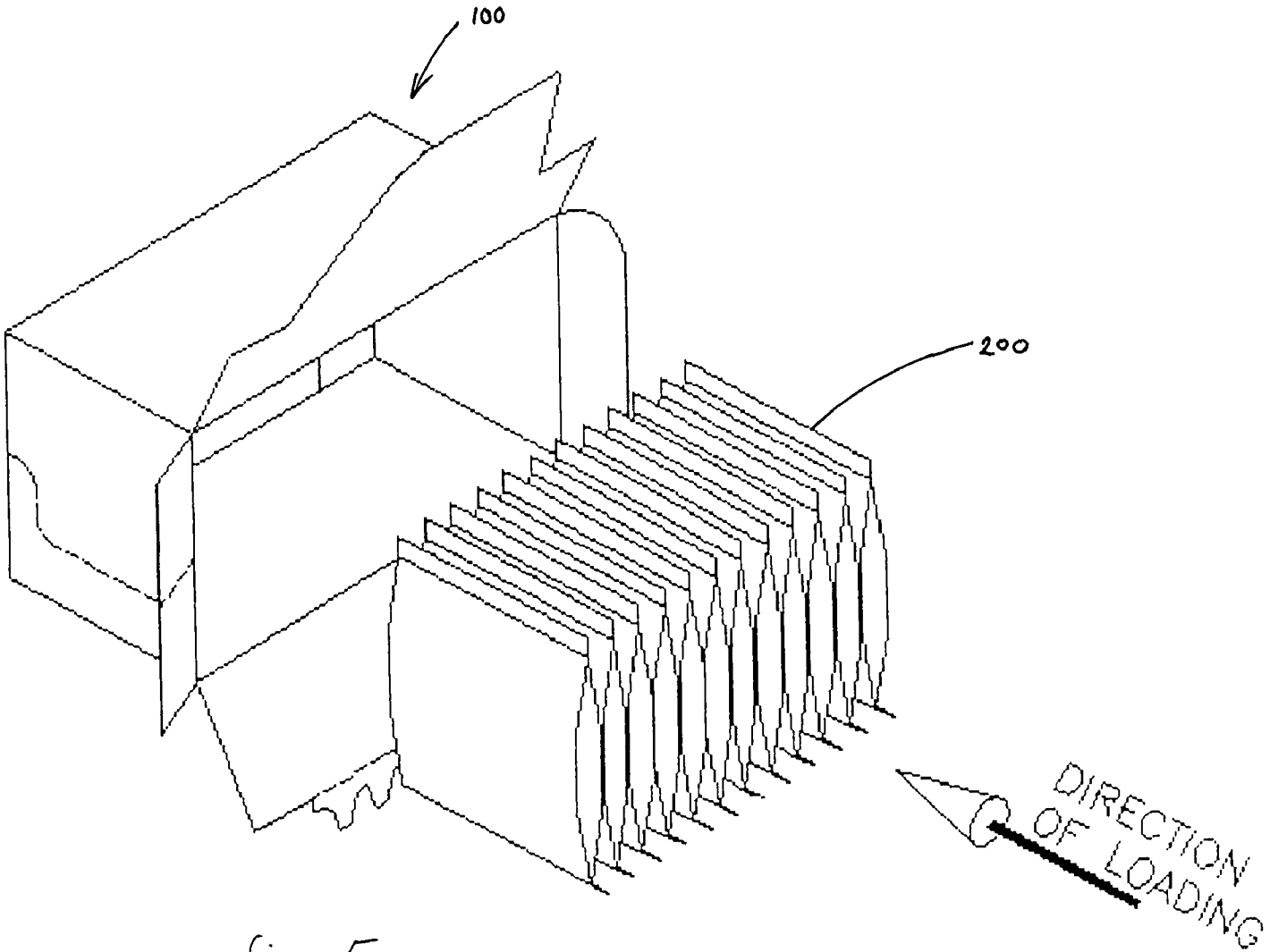
FIG. 5 is a perspective view of the loading step of a method which is an embodiment of the invention.

FIG. 5 demonstrates the loading step of the method of manufacturing and loading a box according to the invention. In this step, the box 100 is in a state where it is completely assembled apart from one open side wall. In this case, sachets 200 are grouped together and side-loaded into the open side, which is then closed. Side-loading is a well known method of loading boxes with products. Side-loading is advantageous because it may be an automated process. Thus, using the box of the present invention, the process of assembling and loading the box can be fully automated. This process may be carried out by a single machine which also performs the steps of erecting and applying adhesive to the blank at the locations required to form the box, thus fully automating the filling procedure. A suitable machine for this purpose is the NSX6 of Jacob White (Packaging) Ltd.

A person skilled in the art will appreciate that the invention can be practised in ways other than those specifically described above; the scope of the present invention is not intended to be limited by the examples.

The invention claimed is:

1. A box formed of a folded blank and having a closed structure having top, base and front and rear end faces and respective pairs of side flaps connected by fold lines respectively to said top and said base, said faces and flaps provided by said blank, and the box having breakable weakness lines allowing when broken complete separation of a top portion including at least part of said top from a remainder of the box, wherein the remainder constitutes a tray structure and wherein, prior to separation of said top portion, vertical support of said top portion on said tray structure is provided by:

(a) contact of a said side flap attached to said top with said base; and (b) edge-to-edge contact of said side flap attached to said top with another said side flap attached to said base;

and wherein said contacts (a) and (b) are provided by respective portions of said side flap attached to said top.

2. A box according to claim 1 wherein said side flap attached to said top has longer and shorter portions, with the longer portion providing said contact (a) and the shorter portion providing said contact (b).

3. A box according to claim 1 wherein said side flap attached to said top overlaps with and lies inside said side flap attached to said base without being adhesively secured thereto and is thereby held in position to achieve said contact (b).

4. A box according to claim 1 wherein one said weakness line is provided at a fold line joining said top to said rear end face.

5. A box according to claim 1 wherein one said weakness line is provided in said front end face between upper and lower edges thereof.

6. A box according to claim 1 wherein said tray structure has an upstanding wall all around said base.

7. A method of forming and loading a box formed of a folded blank and having a closed structure having top, base and front and rear end faces and respective pairs of side flaps connected by fold lines respectively to said top and said base, said faces and flaps all provided by said blank, and the box having breakable weakness lines allowing when broken complete separation of a top portion including at least part of said top from a remainder of the box, wherein the remainder constitutes a tray structure and wherein, prior to separation of said top portion, vertical support of said top portion on said tray structure is provided by:

(a) contact of a said side flap attached to said top with said base; and (b) edge-to-edge contact of said side flap attached to said top with another said side flap attached to said base;

and wherein said contacts (a) and (b) are provided by respective portions of said side flap attached to said top, the method including the steps of:

erecting the blank into a configuration where the top, base and front and rear faces are positioned to form the box and one of the sides of the box is closed while the other side is open;

loading a product through the open side; and thereafter closing the open side.

8. A method according to claim 7 wherein erection of the box, filling of the box and closing of the open side are carried out continuously by machine.

9. A blank for forming a box having, in one piece, at least the following portions:

rectangular top, base and front and rear end faces of the box, connected by three parallel transverse fold lines;

a pair of first side flaps connected by longitudinal fold lines to said base and having a height less than a height of said end faces;

a pair of second side flaps connected by longitudinal fold lines to said top and each having (a) a first portion of a height substantially equal to the height of said end faces and (b) a second portion having a height such that in the erected box said second portion makes edge-to-edge contact with an upper edge of a corresponding said first side flap;

two breakable weakness lines which, when broken, separate at least part of said top completely from said base.

10. A blank according to claim 9 wherein a first one of said weakness lines coincides with one said transverse fold line at one end of said top.

11. A blank according to claim 9 wherein a second one of said weakness lines is located in said front end face intermediately between its upper and lower edges.

12. A box according to claim 1 in a closed state containing a product or a plurality of products.

* * * * *